US006505668B1

(12) United States Patent
Fun

(10) Patent No.: US 6,505,668 B1
(45) Date of Patent: Jan. 14, 2003

(54) ROLLER CURTAIN WITH BACK ROLLING FORCE

(76) Inventor: Fu-Mei Fun, No. 103, Her Tsuoh Street, Taichung (TW)

( * ) Notice: Subject to any disclaimer, the term of this patent is extended or adjusted under 35 U.S.C. 154(b) by 0 days.

(21) Appl. No.: 09/891,282

(22) Filed: Jun. 27, 2001

(51) Int. Cl.[7] ..... A47G 5/02
(52) U.S. Cl. ..... 160/311; 160/321
(58) Field of Search ..... 160/321, 319, 160/309, 310, 311, 312, 190, 133, 370.22, 66, 23.1

(56) References Cited

U.S. PATENT DOCUMENTS 1,821,045 A * 9/1931 Wright ..... 160/311
2,055,511 A * 9/1936 Twiss ..... 160/310
5,044,417 A * 9/1991 Bresson ..... 160/310
6,244,324 B1 * 6/2001 Quates et al. ..... 160/311 X

* cited by examiner

*Primary Examiner*—David M. Purol
(74) *Attorney, Agent, or Firm*—Troxell Law Office PLLC

(57) ABSTRACT

Roller curtain with back rolling force, including: two end members; a locating mechanism connected with a first end member; a hollow reel positioned between the two end members with one end fitted on the locating mechanism, whereby the reel is drivingly rotatable by the locating mechanism for winding or unwinding the curtain; a fluid pressure cylinder in which the piston stem keeps outward extending in normal state, the pressure cylinder being fitted in the reel with the rear end connected with the second end member, the other end of the reel being rotatably fitted with the cylinder body; and a linking device disposed between the reel and the pressure cylinder for converting the rotational movement of the reel into linear movement of the piston stem. When the reel rotates to unwind the curtain, the linking device retracts the piston stem into the cylinder body to reserve a pressure source in the pressure cylinder. When the reel rotates in reverse direction to wind the curtain, the piston stem extends out from the cylinder body and the pressure of the pressure cylinder is relieved to help in rotating back the reel or provide back rotating force for the reel.

14 Claims, 10 Drawing Sheets

ROLLER CURTAIN WITH BACK ROLLING FORCE

BACKGROUND OF THE INVENTION

The present invention is related to a curtain, and more particularly to a roller curtain which can be wound up or unwound down. The roller curtain has a back rolling structure which provides back rolling force for ascending the curtain.

A conventional roller curtain has a reel and a curtain wound on the reel. When rotating the reel, the curtain is released down. When rotating the reel in a reverse direction, the curtain is recovered.

When pulling a bead chain or a pull cord of the roller curtain to drivingly rotate the roller curtain and unwind the curtain, the curtain will fall due to gravity. Therefore, it is easier to release the curtain. Reversely, when winding the curtain, it is necessary to over the gravity so that it is strength-costing to pull the bead chain. In order to solve this problem in operation, a resilient restoring mechanism is installed in the rail of the curtain. The restoring mechanism has a torque spring in which a resilient energy is reserved when releasing the curtain. When winding the curtain, the resilient energy helps in turning back the reel so as to save strength.

SUMMARY OF THE INVENTION

It is a primary object of the present invention to provide a roller curtain which is other than torque spring and able to provide back rolling force for ascending the curtain.

The present invention can be best understood through the following description and accompanying drawings wherein:

DETAILED DESCRIPTION OF THE PREFERRED EMBODIMENTS

Figure 1:
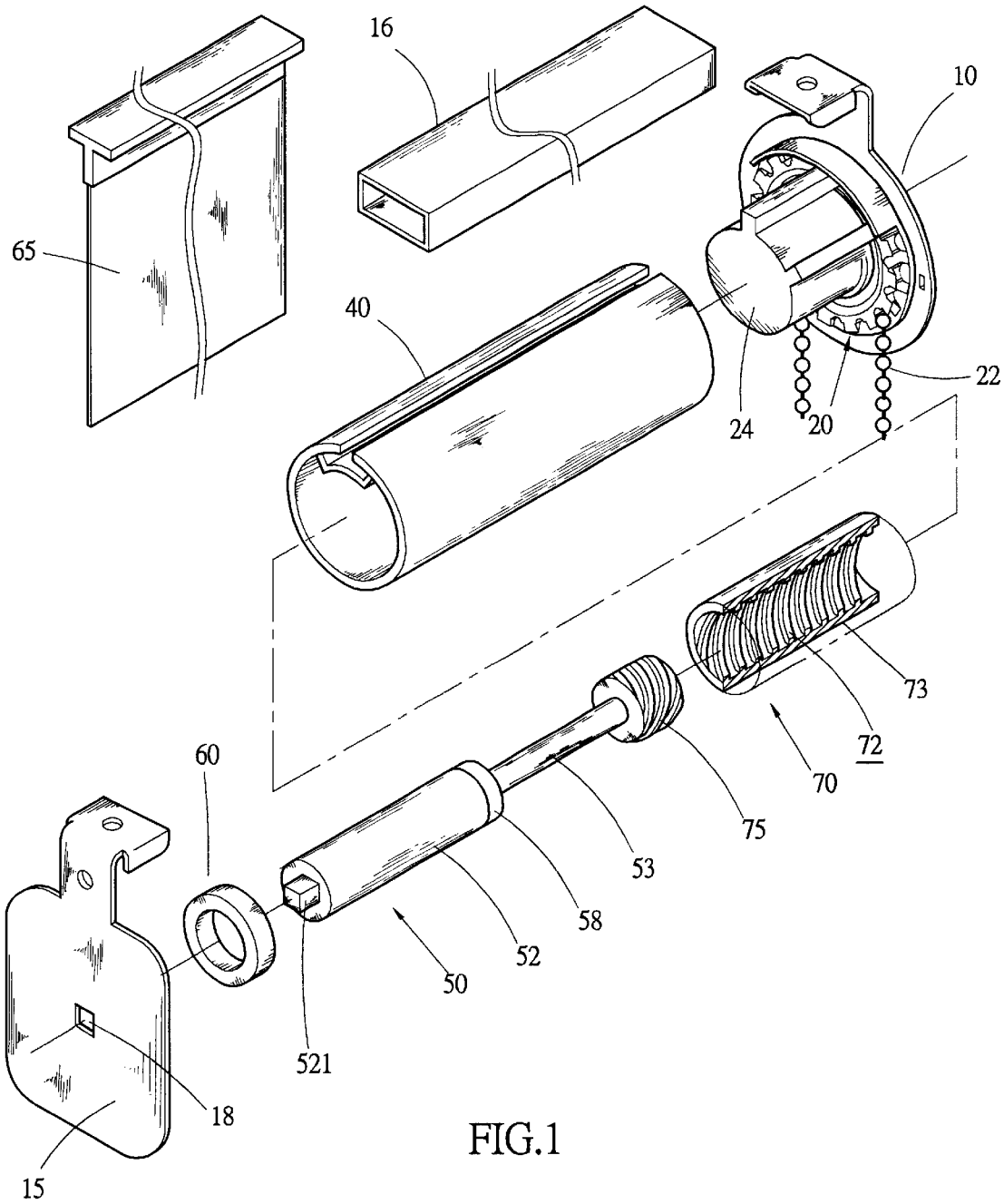
FIG. 1 is a perspective exploded and partially sectional view of a preferred embodiment of the present invention.
Figure 2:
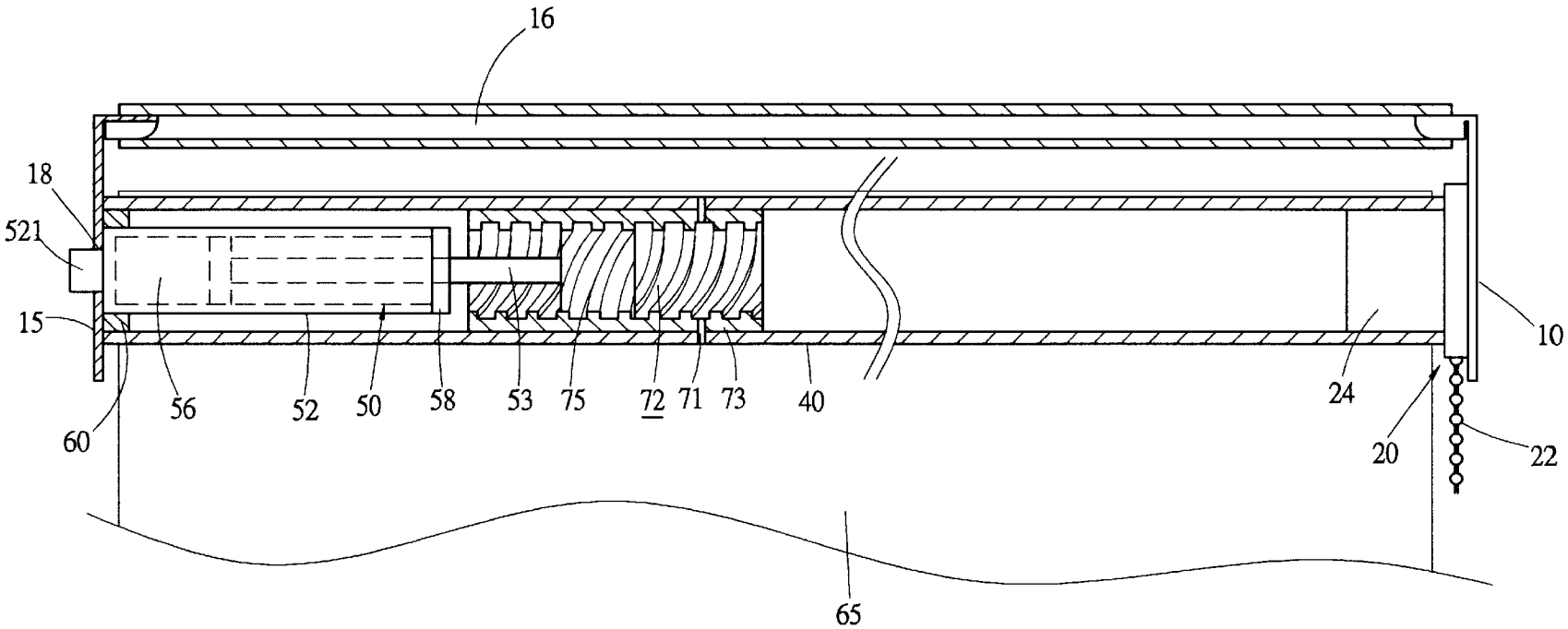
FIG. 2 is a longitudinal sectional assembled view of the embodiment of FIG. 1.
Figure 3:
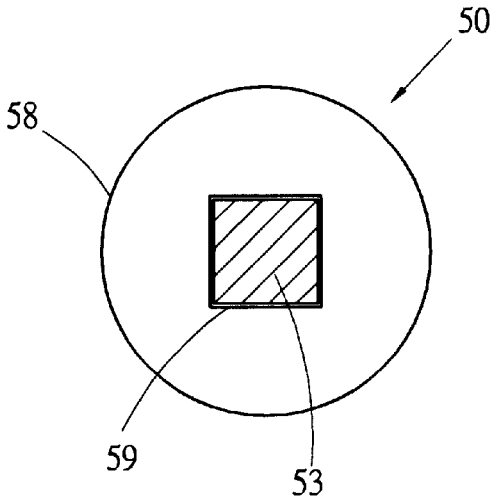
FIG. 3 is a sectional view of the pressure cylinder of FIG. 2.
Figure 4:
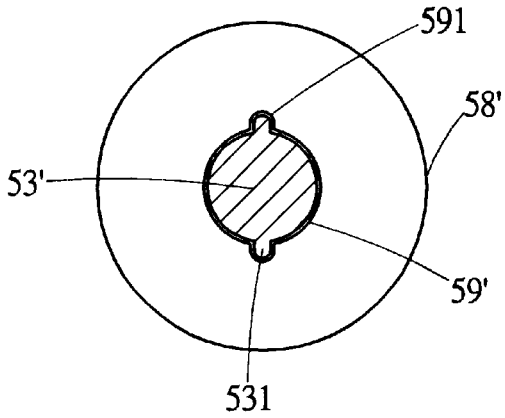
FIG. 4 is a view according to FIG. 3, showing another aspect of the piston stem.

Please refer to FIGS. 1 and 2. According to a first embodiment, the roller curtain of the present invention includes:

two end members 10, 15 for fixing the entire roller curtain on wall faces, an elongated upper rail 16 being omissibly connected with top ends of the end members 10, 15 to beautify the appearance;

a locating mechanism which in this embodiment is a bead chain mechanism 20 connected with the end member 10, whereby the winding and unwinding of the roller curtain can be controlled by means of pulling the bead chain 22, a cylindrical section 24 outward projecting from one side of the end member 10 toward the other end member 15, the cylindrical section 24 being drivingly rotatable by the bead chain mechanism 20, the end members and bead chain pertaining to prior art;

a reel 40 which is a tube body positioned between the two end members 10, 15 with one end fitted on the cylindrical section 24;

a fluid pressure cylinder which can be an oil pressure cylinder or a pneumatic cylinder, in this embodiment, the pneumatic cylinder being exemplified, the pneumatic cylinder 50 having a cylinder body 52 and a piston stem 53, a high pressure gas being filled in the gas room 56 of the cylinder body 52, whereby the piston stem 53 keeps outward projecting in normal state. The piston stem 53 is extensible from the cylinder body without rotation. In order to achieve this, as shown in FIG. 3, the piston stem 53 is a square stem and the cylinder head 58 is formed with a square hole 59 for the piston stem to extend therethrough. Alternatively, as shown in FIG. 4, the circular piston stem 53' is formed with ribs 531 and the circular hole 59' of the cylinder head 58' is formed with recesses 591 in which the ribs 531 are inlaid. Acccordingly, the piston stem is engaged with the cylinder head and is only extensible along the cylinder body without rotation. The measures for sliding the piston stem without rotation are not limited to the above two measures. The pneumatic cylinder 50 is fitted in the reel 40 with the piston stem 53 directed inward. The rear end of the cylinder body 52 is connected with the other end member 15 and located. The rear end of the cylinder body 52 is located in such a manner that the rear end is formed with a square boss 521 engaged in an engaging hole 18 of the end member 15 so that the cylinder body will not rotate. Alternatively, the rear end of the cylinder body is fixed on the end member by screws to connect the cylinder body with the end member without rotation.

Figure 5:
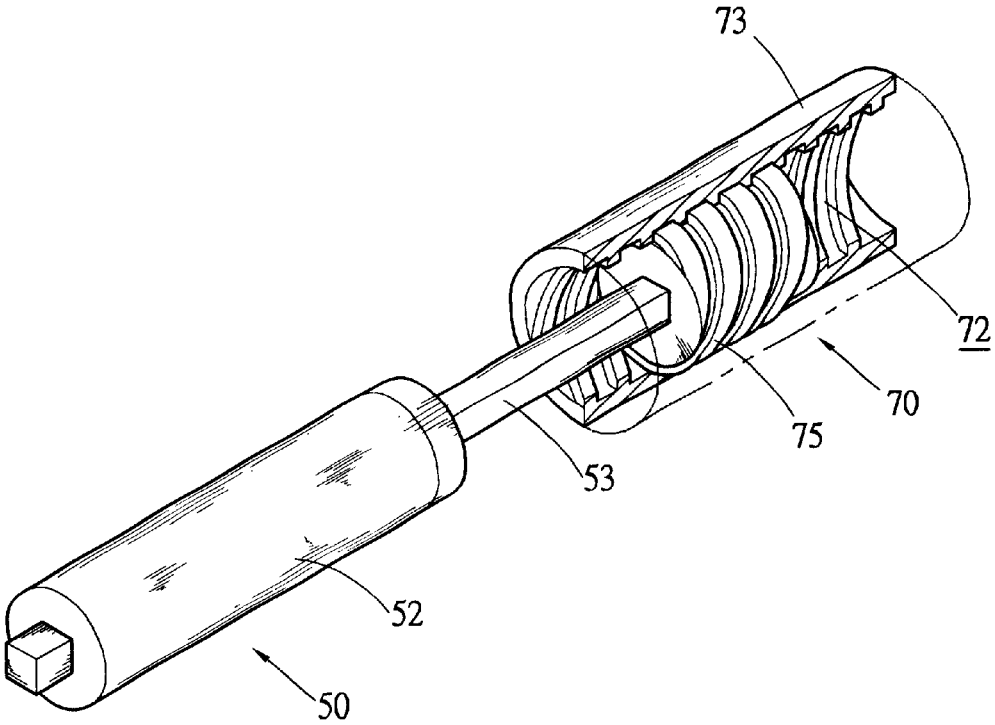
FIG. 5 shows the engagement of the linking device of FIG. 1.

The present invention further includes:

a collar 60 which is a ring body fitted around the cylinder body 52, the other end of the reel 40 being fitted with the collar 60, whereby two ends of the reel are respectively rotatably fitted with the cylindrical section 24 and the cylinder body 52;

a curtain 65 the top edge of which is connected with the reel 40 to be wound on the reel; and a linking device 70 including a spiral flute section 72 and a spiral tooth section 75. The spiral flute section 72 has a predetermined length and is disposed on inner circumference of the reel 40. In this embodiment, a tubular inner sleeve 73 with a predetermined length is nested into the reel 40 and fixed at a certain position without sliding or displacement. The inner sleeve is fixed by an insertion pin 71 as shown in FIG. 2 or other equivalent measure. The inner circumference of the inner sleeve 73 is formed with continuous spiral teeth to form the spiral flute section 72 on the inner circumference of the reel. In this embodiment, the spiral tooth section 75 is a spiral tooth gear fixed at the free end of the piston stem 53 without rotation. The spiral tooth section 75 is engaged with the spiral flute section 72 as shown in FIG. 5.

Figure 6:
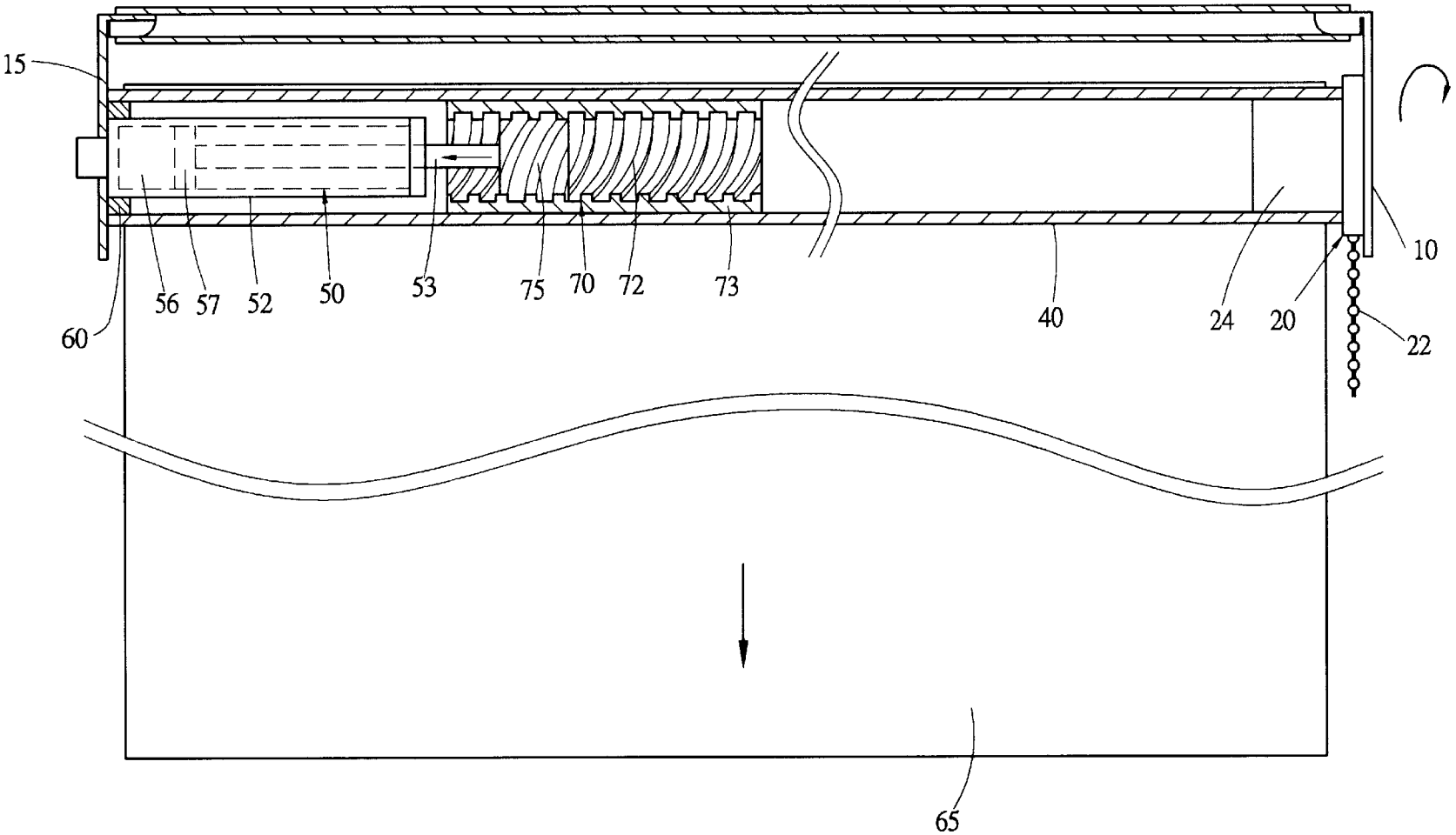
FIG. 6 is a view according to FIG. 2, showing the unwinding operation the curtain.
Figure 7:
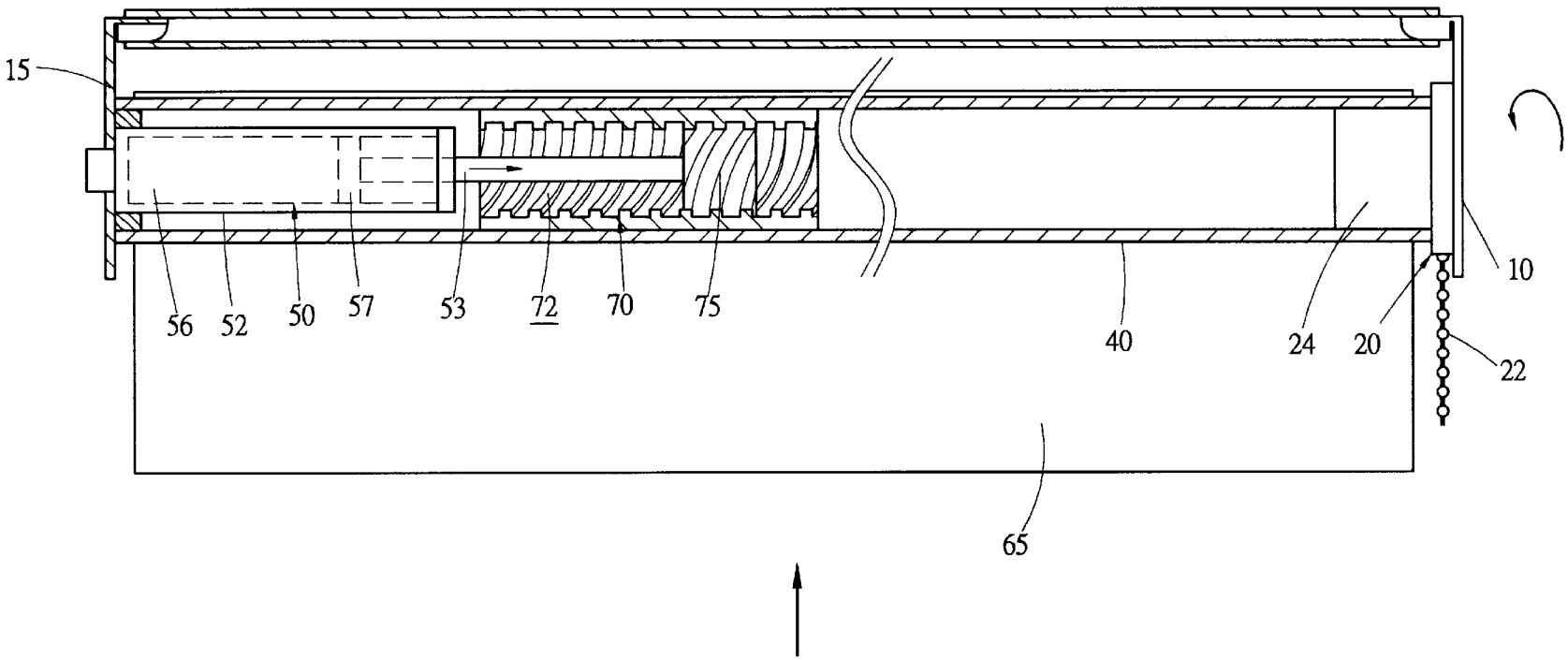
FIG. 7 is a view according to FIG. 6, showing the winding operation the curtain.

FIGS. 6 and 7 show the use of the present invention. When the reel 40 is driven and rotated the curtain is ascended or descended. When pulling the bead chain 22, via the cylindrical section 24, the reel 40 is driven to clockwise rotate as shown in FIG. 6. When the reel rotates, the curtain 65 is descended. The spiral flute section 72 is rotated along with the reel to exert a driving force onto the spiral tooth section 75. The piston stem 53 will not rotate so that by means of the engagement between the spiral flute section 72 and the spiral tooth section 75, the rotation of the reel is converted into linear movement. Therefore, the piston stem 53 together with the spiral tooth section 75 is axially linearly slided and retracted into the cylinder body 52. At this time, the gas in the gas room 56 is compressed by the piston 57 to increase the gas pressure and reserve a pressure source.

Reversely, when pulling the bead chain 22 to counterclockwise rotate the reel 40, as shown in FIG. 7, the curtain 65 is ascended. At this time, by means of the engagement between the spiral flute section 72 and the spiral tooth section 75, the rotation of the reel is converted into displacement of the piston stem 53. Therefore, the piston stem 53 gradually extends out from the cylinder body 52. The gas pressure in the gas room 56 is thus relieved to act on the piston 57. The piston stem 53 exerts an axial force onto the reel to enhance the counterclockwise rotation of the reel, whereby the strength for winding the curtain can be saved.

Figure 8:
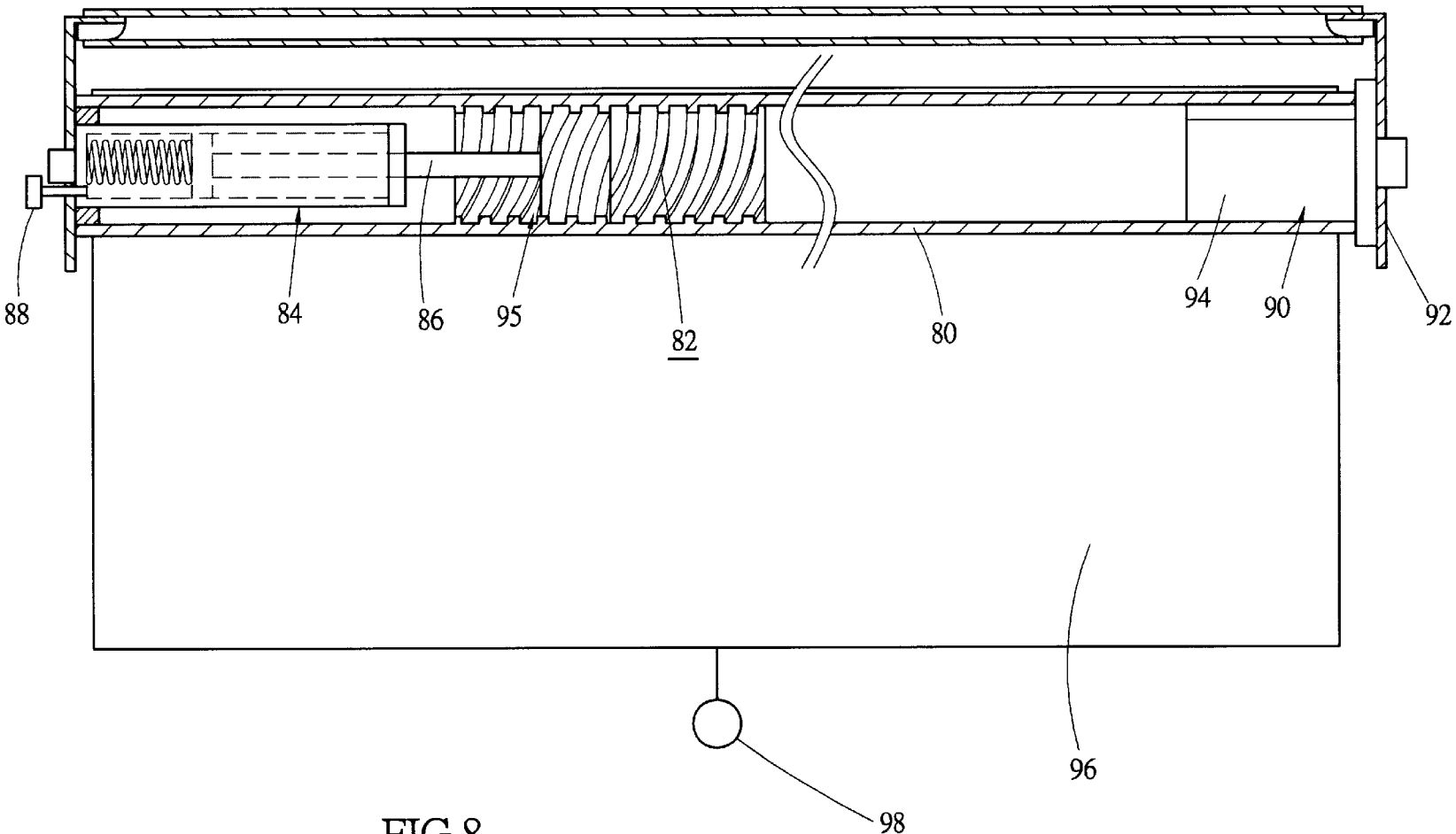
FIG. 8 is a longitudinal sectional view of another embodiment of the present invention.

FIG. 8 shows another embodiment of the present invention, which is substantially identical to the first embodiment in structure. The difference between the two embodiments is that the spiral flute section 82 is directly formed on inner circumference of the reel 80. The pressure cylinder is an oil pressure cylinder 84 having greater pressure value than the pneumatic cylinder. The piston stem 86 is pushed by a spring and kept extending outward. The rear end of the oil pressure cylinder 84 is provided with an adjustment button 88 for controlling the flow amount of the fluid in the oil pressure cylinder and adjusting the damp. The locating mechanism is a rotary locating mechanism 90 which pertains to prior art. One end of the locating mechanism is fixedly connected with an end member 92, while the cylindrical section 94 at the other end is fitted with one end of the reel 80.

In use, a pull hook 98 is disposed on bottom edge of the curtain 96 for pulling down the curtain. When the reel 80 rotates, the locating mechanism 90 is driven and rotated and the oil pressure cylinder simultaneously reserves a pressure source. After the curtain is unwound to a predetermined height and stopped, the locating mechanism provides a locating and fixing effect for the reel.

When winding the curtain, the curtain is further pulled downward by a short distance, whereby the locating mechanism 90 is released from the fixed state, permitting the reel 80 and the cylindrical section 94 to freely rotate. At this time, the oil pressure cylinder 84 releases the pressure source which is converted by the linking device 95 into rotary movement to drive and rotate back the reel for winding the curtain.

Figure 9:
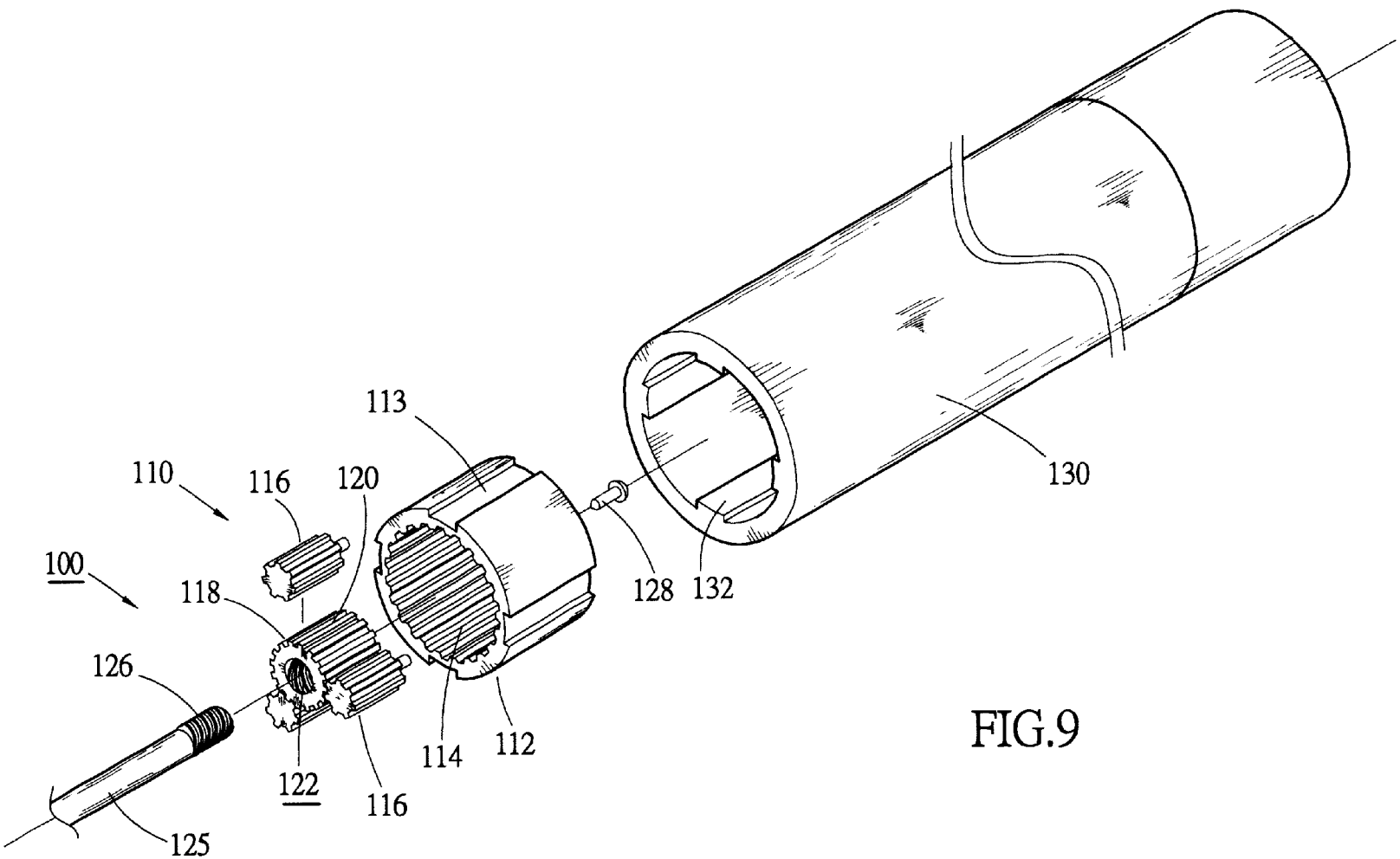
FIG. 9 is a perspective view of a part of still another embodiment of the present invention.
Figure 10:
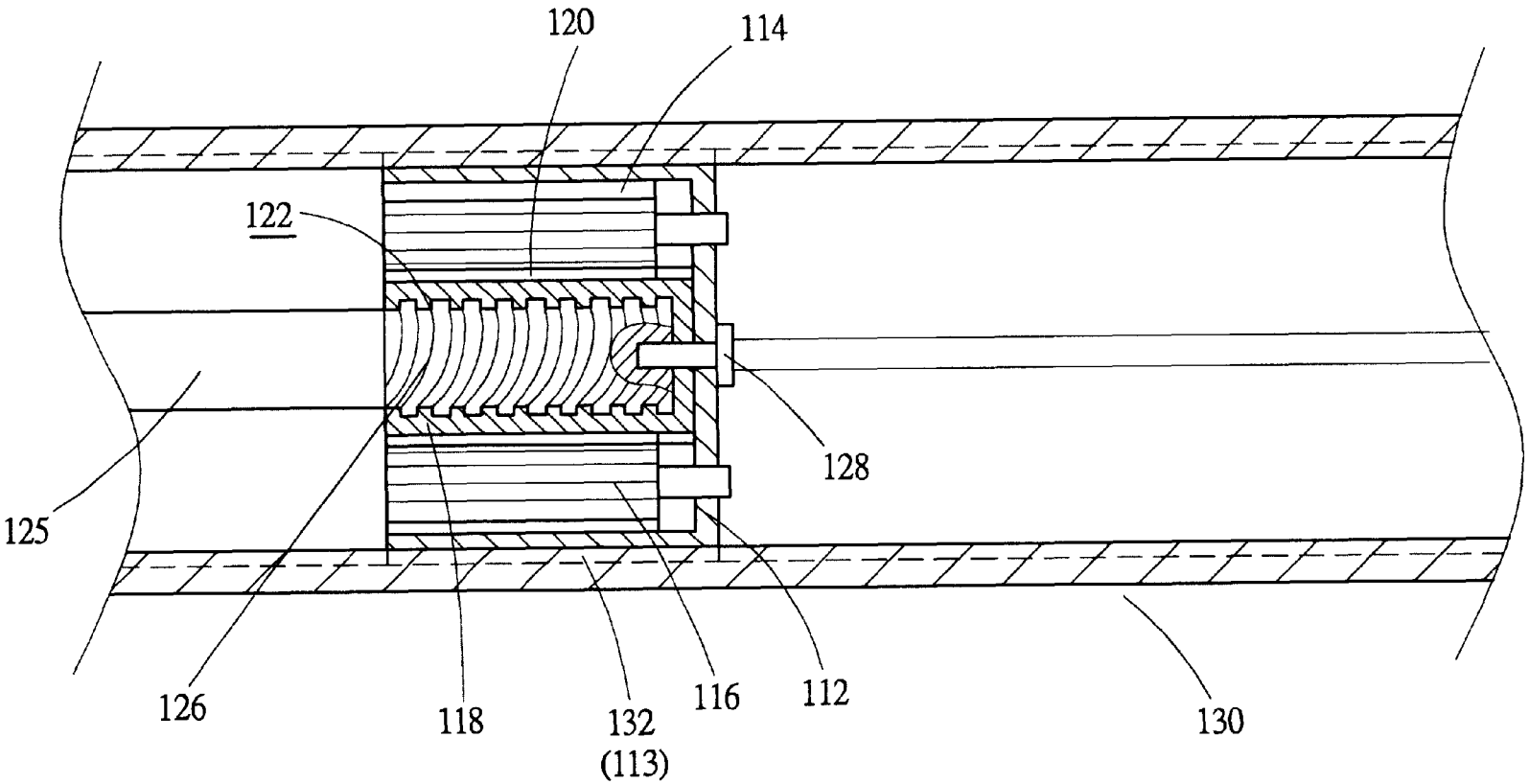
FIG. 10 is a sectional assembled view of the embodiment of FIG.

FIGS. 9 and 10 shows still another embodiment of the present invention, in which only the structure related to the linking device 100.

The linking device 100 includes a reducing mechanism 110 having: a cylindrical body 112, the inner circumference of the cylindrical body 112 being formed with an annular toothed section 114; three planet gears 116 rotatably disposed in the cylindrical body 112 at a close end face thereof and engaged with the toothed section 114 thereof; and an inner sleeve 118 received in the cylindrical body 112. The outer circumference of the inner sleeve 118 is formed with an annular toothed section 120 for engaging with the planet gears 116.

The spiral flute section 122 is formed on inner circumference of the inner sleeve 118.

The front end of the piston stem 125 of the pressure cylinder is formed with a spiral tooth section 126 for engaging with the spiral flute section 122. A connecting member 128 such as a shaft rod extends through the end faces of the cylindrical body 112 and the inner sleeve 118 to rotatably connect with the front end of the piston stem 125, whereby the reducing mechanism 110 is kept freely operably connecting with the piston stem without detaching therefrom.

After the pressure cylinder and the linking device are installed into the reel 130, the axial ribs 132 of the inner circumference of the reel 130 are inlaid in the axial channels 113 formed on outer circumference of the cylindrical body 112, whereby the cylindrical body is engaged with the reel.

When the reel 130 is rotated, the cylindrical body 112 is synchronously driven and rotated. Through the planet gears 116, the inner sleeve 118 is driven and rotated. The planet gears 116 provide reducing effect, whereby the rotational speed of the inner sleeve is less than that of the cylindrical body. When the inner sleeve 118 rotates, the spiral flute section 122 acts on the spiral tooth section 126 to axially displace the piston stem 125.

The reducing mechanism 110 is connected with the piston stem and displaceable along therewith. By means of the engagement between the ribs 132 of the reel and the channels 113 of the cylindrical body 112, the cylindrical body 112 can smoothly displace along the axis of the reel. Accordingly, when the reel rotates, the reducing mechanism rotates and displaces and the spiral flute section 122 also rotates and displaces.

This embodiment even more saves the strength for driving the reel. Moreover, with fixed travel of the piston stem, the number of the rotational circles of the reel is increased.

Figure 11:
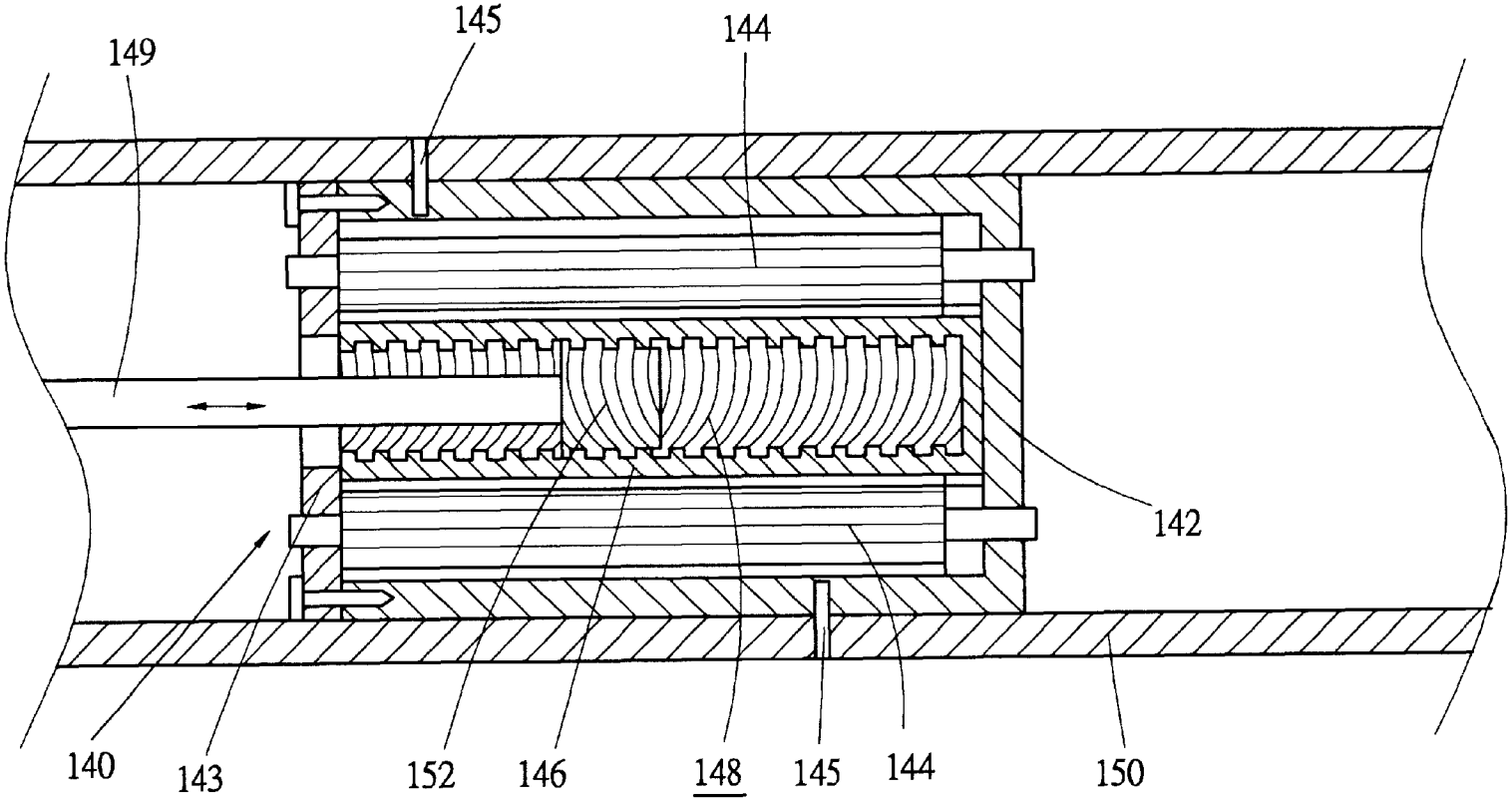
FIG. 11 is a longitudinal sectional view of still another embodiment of the present invention.

FIG. 11 shows still another embodiment of the present invention, which has a structure and function substantially identical to those of the embodiment of FIGS. 9 and 10. This embodiment also has a cylindrical body 142, several planet gears 144 and an inner sleeve 146. The difference is that the cylindrical body 142 and the inner sleeve 146 both have a considerable length. The inner sleeve is stopped by an end cap 143 of the cylindrical body 142 from slipping out. When the reducing mechanism 140 is installed in the reel 150, the cylindrical body 142 is fixedly connected with the reel, for example, by an insertion pin 145 as shown in the figure without sliding within the reel. Also, the spiral flute section 148 has a certain length. Accordingly, the reducing mechanism is rotatable along with the reel without displacement. The spiral tooth section 148 has a certain length in accordance with the travel of the piston stem 149 and the spiral tooth section 152.

Figure 12:
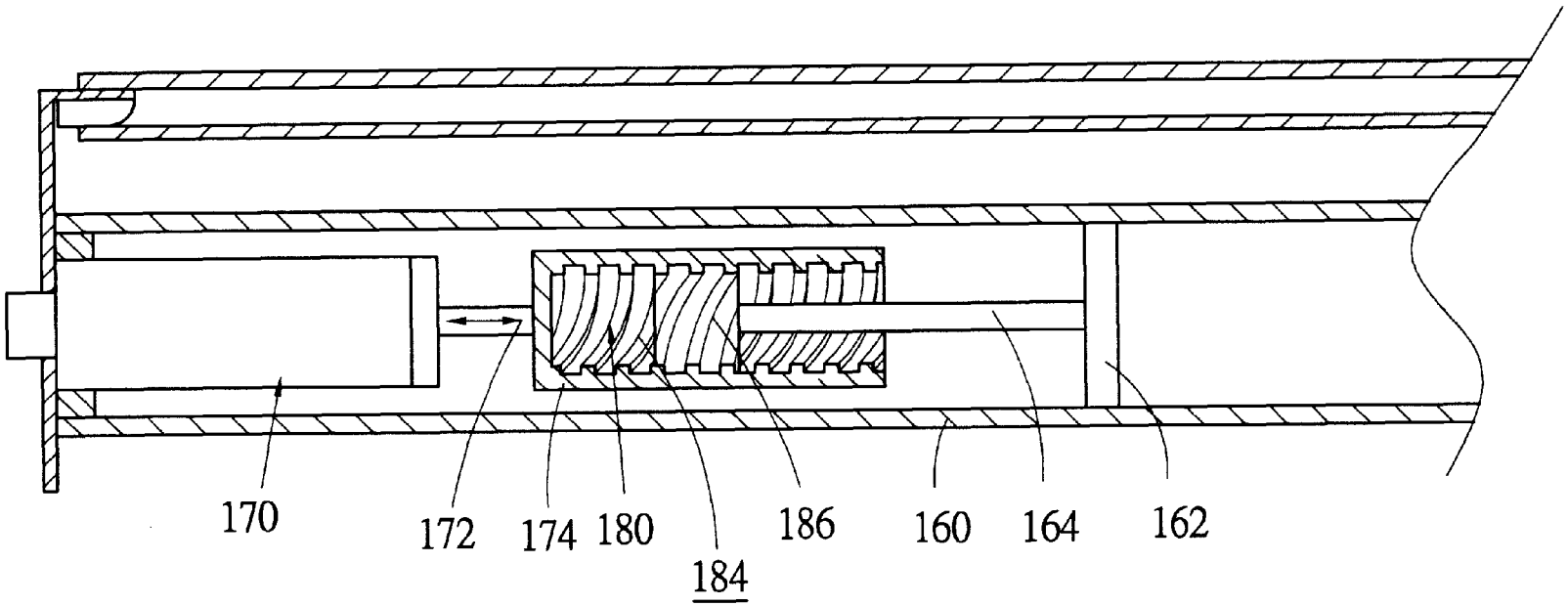
FIG. 12 is a longitudinal sectional view of still another embodiment of the present invention.

FIG. 12 is a partially longitudinal sectional view of still another embodiment of the present invention. The major difference between this embodiment and the above embodiments is that the spiral flute section and the spiral tooth section of the linking device are exchanged in position. That is, a support 162 is disposed in the reel 160. The support has an axial stem 164. The front end of the piston stem 172 of the pressure cylinder 170 is fixedly connected with an elongated cylindrical body 174. The spiral flute section 184 of the linking device 180 is disposed on inner circumference of the cylindrical body 174. The spiral tooth section 186 is disposed at front end of the stem 164and engaged with the spiral flute section 184. When the reel 160 rotates, the spiral tooth section 186 is synchronously driven and rotated. By means of the engagement between the spiral flute section 184 and the spiral tooth section, the rotation of the reel is converted into linear displacement of the cylindrical body 174 and the piston stem 172.

In the embodiment of FIG. 12, a reducing mechanism can be disposed in the linking device to save strength for operation and vary the ratio of the number of rotational circles of the reel to the travel of the piston stem.

The above embodiments are only used to illustrate the present invention, not intended to limit the scope thereof. Many modifications of the above embodiments can be made without departing from the spirit of the present invention.

What is claimed is:

1. Roller curtain with back rolling force, comprising:

two end members for fixing the roller curtain on wall faces, the end members being spaced apart from each other;

a locating mechanism connected with a first of the two end members;

a reel which is a tube body positioned between the two end members with a first end fitted on the locating mechanism, whereby the reel is drivingly rotatable by the locating mechanism;

a fluid pressure cylinder having a cylinder body and a piston stem axially passing through the cylinder body, such that, when not subject to external force, a front end of the piston stem is outwardly projecting, the piston stem being extensible from the cylinder body without rotation, the pressure cylinder being fitted in the reel with the piston stem directed inwardly, a rear end of the cylinder body being connected with a second of the two end members, a second end of the reel being rotatably fitted with the cylinder body;

a curtain connected with the reel and wound or unwound by the reel; and a linking device disposed between the reel and the piston stem of the pressure cylinder, the linking device connecting rotational movement of the reel into linear movement of the piston stem in parallel to an axis of the reel, whereby when the reel rotates to unwind the curtain, the linking device retracts the piston stem into the cylinder body to reserve a pressure source in the pressure cylinder, while when the reel rotates in a reverse direction to wind the curtain, the linking device makes the piston stem extend out from the cylinder body and the pressure of the pressure cylinder is relieved to enhance the displacement of the piston and to provide back rotating force for the reel, wherein the linking device further includes a spiral flute section and a spiral tooth section, the spiral flute section having a plurality of spiral flutes and disposed on an inner circumference of the reel and rotatable along therewith, the spiral tooth section having a plurality of spiral teeth and being disposed at a front end of the piston stem, the spiral tooth section being engaged with the spiral flute section.

2. The roller curtain as claimed in claim 1, wherein the spiral flute section is rotatable along with the reel without displacement.

3. The roller curtain as claimed in claim 2, wherein the spiral flute section rotates at a speed equal to that of the reel.

4. The roller curtain as claimed in claim 2, wherein the spiral flute section is directly formed on the inner circumference of the reel.

5. The roller curtain as claimed in claim 2, further comprising a tubular inner sleeve, the inner circumference of the inner sleeve being formed with continuous spiral teeth, the inner sleeve having a predetermined length and fixedly disposed in the reel and rotatable along therewith without sliding or displacement, the spiral teeth of the inner sleeve forming the spiral flute section.

6. The roller curtain as claimed in claim 2,wherein the linking device has a reducing mechanism, whereby the rotational speed of the spiral flute section is lower than that of the reel.

7. The roller curtain as claimed in claim 6, wherein the reducing mechanism includes: a cylindrical body, an inner circumference of the cylindrical body being formed with an annular toothed section; a predetermined number of planet gears rotatably disposed in the cylindrical body and engaged with the toothed section thereof; and an inner sleeve received in the cylindrical body without sliding therewithin and having a predetermined length, an outer circumference of the inner sleeve being formed with an annular toothed section engaging the planet gears, the spiral flute section being formed on inner circumference of the inner sleeve, the reducing mechanism being received in the reel, the outer circumference of the cylindrical body being fixedly connected with the inner face of the wall of the reel, the spiral tooth section of the piston stem being engaged with the spiral flute section.

8. The roller curtain as claimed in claim 1, wherein the linking device includes a reducing mechanism and the spiral flute section is rotatable along with the reel and displaceable along with the piston stem.

9. The roller curtain as claimed in claim 8, wherein the reducing mechanism includes: a cylindrical body, an inner circumference of the cylindrical body being formed with an annular toothed section; a predetermined number of planet gears rotatably disposed in the cylindrical body and engaged with the toothed section thereof; and an inner sleeve received in the cylindrical body without slipping out therefrom, an outer circumference of the inner sleeve being formed with an annular toothed section engaging the planet gears, the spiral flute section being formed on inner circumference of the inner sleeve, the reducing mechanism being received in the reel, the outer circumference of the cylindrical body being inlaid in the inner face of the wall of the reel, whereby the reducing mechanism is slidable along the axis of the reel and rotatable along with the reel, the spiral tooth section of the piston stem being engaged with the spiral flute section, the reducing mechanism being kept engaged with the spiral tooth section and displaceable along with the piston stem.

10. The roller curtain as claimed in claim 9, wherein each of the cylindrical body and the inner sleeve has a closed end and an open end, the inner sleeve being disposed in the cylindrical body from the open end thereof, the spiral tooth section being screwed with the spiral flute section from the open end of the inner sleeve, a connecting member extending through the closed ends of the cylindrical body and the inner sleeve to rotatably connect with the front end of the piston stem.

11. The roller curtain as claimed in claim 1, wherein the linking device has a spiral flute section and a spiral tooth section, the spiral flute section having a plurality of spiral flutes and connected with the piston stem without rotation, the spiral tooth section disposed in the reel and rotatable along therewith, the spiral tooth section being engaged with the spiral flute section.

12. The roller curtain as claimed in claim 11, wherein a support is disposed in the reel, the support having a stem parallel to an axis of the reel, the front end of the piston stem being fixedly connected with one end of an elongated cylindrical body, an axis of the cylindrical body being parallel to the axis of the reel, the stem extending into the cylindrical body from an end thereof, the spiral flute section being disposed on an inner circumference of the cylindrical body and the spiral tooth section being disposed on the stem.

13. The roller curtain as claimed in claim 12, wherein the linking device includes a reducing mechanism for varying a ratio of a rotational speed of the reel to a rotational speed of the spiral tooth section.

14. The roller curtain as claimed in claim 1, wherein the locating mechanism is a bead chain mechanism rotating the reel.

* * * * *